US007703261B2

(12) United States Patent
Bedashyov

(10) Patent No.: US 7,703,261 B2
(45) Date of Patent: Apr. 27, 2010

(54) METHOD FOR CREATING A SOUVENIR AMUSEMENT ITEM

(76) Inventor: Igor Bedashyov, 11653 Newbridge Ct., Reston, VA (US) 20191-3514

( * ) Notice: Subject to any disclaimer, the term of this patent is extended or adjusted under 35 U.S.C. 154(b) by 260 days.

(21) Appl. No.: 11/830,977

(22) Filed: Jul. 31, 2007

(65) Prior Publication Data

US 2009/0036226 A1 Feb. 5, 2009

(51) Int. Cl.
*B65B 31/00* (2006.01)
*F17C 5/06* (2006.01)

(52) U.S. Cl. ..... 53/403; 40/310; 53/79; 141/4; 206/0.6; 206/459.5; 446/491; 472/137

(58) Field of Classification Search ..... 53/403, 53/79; 40/310, 311; 141/4; 206/0.6, 457, 206/459.5; 446/267, 491; 472/137
See application file for complete search history.

(56) References Cited

U.S. PATENT DOCUMENTS 2,361,423 A * 10/1944 Snyder ..... 40/410
4,521,982 A * 6/1985 Altuchow ..... 40/407
4,600,102 A * 7/1986 Avila ..... 206/459.5
4,842,140 A * 6/1989 Mesnard ..... 206/459.5
5,749,402 A * 5/1998 Stotelmyer et al. ..... 141/4
6,903,736 B1 * 6/2005 Stefan ..... 345/419

OTHER PUBLICATIONS

"Run-Up To The Hand-Over; Souvenir Hounds Grab Piece of Colony on Eve of History," Evelyn Iritani and Sylvia Cavallini, Jun. 29, 1997, Los Angles Times, http://pqasb.pqarchiver.com/latimes, 2 pages retrieved Nov. 19, 2009.*
"Air of America, LLC, Unique Souvenirs," © 2007-2008, http://www.airofamerica.biz, 6 pages retrieved Nov. 19, 2009.*

* cited by examiner

*Primary Examiner*—Stephen F Gerrity
(74) *Attorney, Agent, or Firm*—The Marbury Law Group PLLC

(57) ABSTRACT

An amusement item comprising a container filled with compressed air from a geographic location of interest. Compressed air from a geographic region is collected and transported to a manufacturing facility for the production of novelty containers containing the compressed air. Containers are labeled with the region/location from which the compressed air is obtained. Certification and quality is maintained by obtaining records of the chemical make-up of the air at the source and comparing that electronic record to cylinders of air from the geographic location to ensure accuracy of labeling and filling. The amusement items are sold as souvenirs.

5 Claims, 3 Drawing Sheets

METHOD FOR CREATING A SOUVENIR AMUSEMENT ITEM

FIELD OF THE INVENTION

The embodiments described herein relate to an amusement item in the form of a novelty container. More particularly, embodiments relate to souvenir novelty containers containing compressed air from a location to be sold as a memento of travel to a particular area or as a novelty gift reminiscent of geographic regions.

BACKGROUND

Sales of souvenir amusement items is an important aspect of any vacation or travel. The souvenir industry is large in not only the US but in many countries. There is a constant incentive to come up with souvenir items that are new and that will entice travelers to purchase them. Such factors as novelty and affiliation with the areas in which a tourist might be traveling are factors that will entice a buyer to purchase one souvenir over another.

Although souvenir items are typically associated with inexpensive prices, this does not mean that quality control and accurate representations of the regions from which the souvenir is purchased are not important factors. Souvenir buyers want to be assured that souvenirs they purchase actually represent the areas that they are visiting.

Souvenir items of one region may be made in entirely different region. In such cases, this may, in the mind of the consumer, lessen the souvenir value of that specific item. Thus it would be useful to have a souvenir that is representative of a geographic region and, at the same time, give assurances to the purchaser that it truly represents the region that it purports to do.

SUMMARY

Embodiments described herein related to amusement items in the form of souvenir cans, glass jars, plastic cylinders and other vessels (hereinafter "containers" that contain air from different geographic regions.

Other embodiments comprise labeled containers that are representative of air from different regions such as New York, Washington D.C., and other cities and regions in not only the US but all over the world.

Further embodiments comprise a system for assuring that the air contained in containers is actually from the geographic region described in labeling on the container in questions.

Other embodiments comprise a quality control system for the container souvenirs that assures accuracy of the contents during manufacture.

Still other, embodiments comprise testing of air to be used to fill containers at the source to establish a "fingerprint" for that air which can be used to compare the contents of air used to fill containers at a location remote from the air source.

These and other embodiments will be apparent to those skilled in the art from a review of the detailed description below

DETAILED DESCRIPTION

Figure 1:
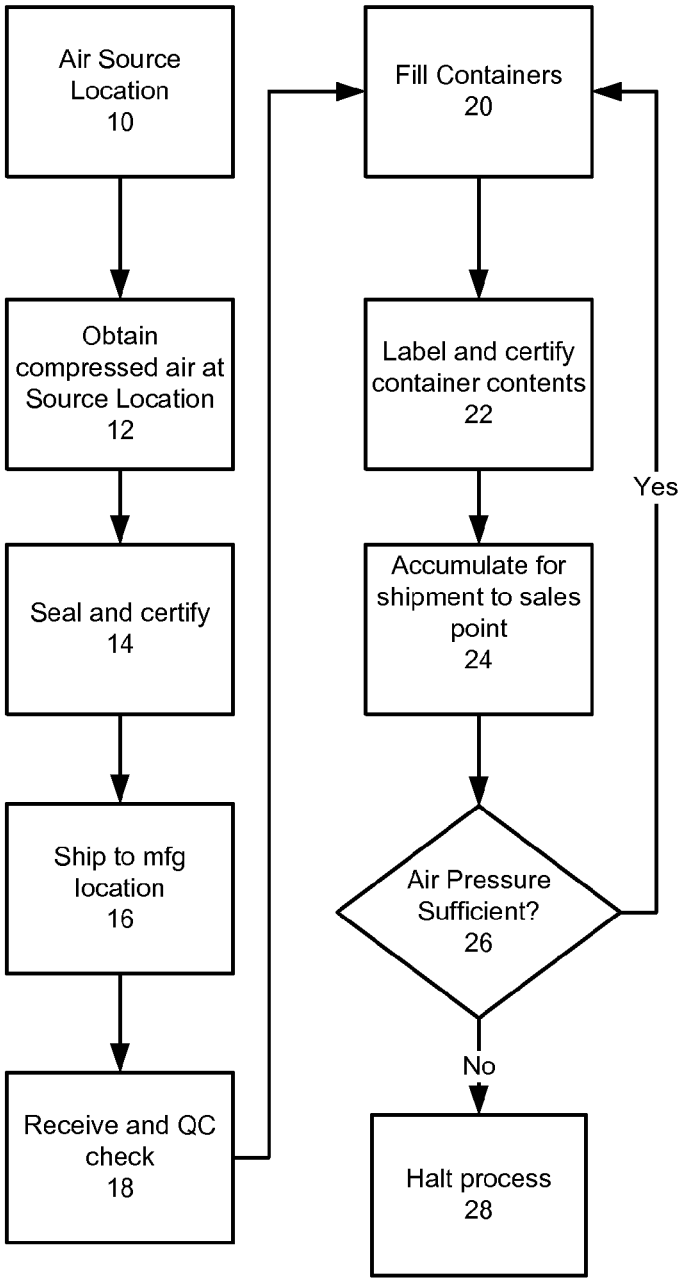
FIG. 1 illustrates an overall flow of the process for creating souvenir containers.

Referring to FIG. 1 the overall process flow of creating the souvenir air containers is illustrated. An air source is first identified as useful for souvenir containers 10. This may, for example but without limitation, be selected regions of the US or the world such as New York, Washington D.C., Orlando Fla. and the like. There is no restriction of the region from which air is to be gathered.

Once the source is identified, compressed air is obtained 12, using methods known to those in the art. For manufacturing purposes, it may be necessary to obtain many compressed air cylinders filled with air from the region in question so as to allow manufacture of a large number of filled souvenir containers.

The air source and location is recorded and certified and sealed 14 at the site by those filling the containers so as to assure those involved in subsequent manufacturing that the compressed air in the cylinders is from the region in question and can be readily identified as such during manufacturing operations.

The compressed air cylinders are then shipped 16 and received at the manufacturing site 18 where they are logged in and inspected to assure that no seals have been broken. The sources of the compressed air are logged into the manufacturing system so that containers with appropriate labeling are used with the compressed air from the region. This assures accuracy of the air container contents.

Containers having the appropriate labeling identifying the regions are then pulled from stock and placed in an assembly process and filled 20 with air from the compressed air cylinders from the region depicted on the labeled containers and sealed. The containers are then certified by a quality control inspection 22 as having been filled by compressed air from the region in question. The finished containers are then accumulated for shipping 24.

Throughout the process, the manufacturing system is constantly monitored to insure that compressed air from the region in question is being used to fill the containers. Should the compressed air run out 26, the process is halted 30. So long as compressed air pressure is appropriate, manufacturing operations continue. Again, this is a way to insure to the ultimate consumer that the souvenir containers are filled with air from the regions identified on the container labeling.

Figure 2:
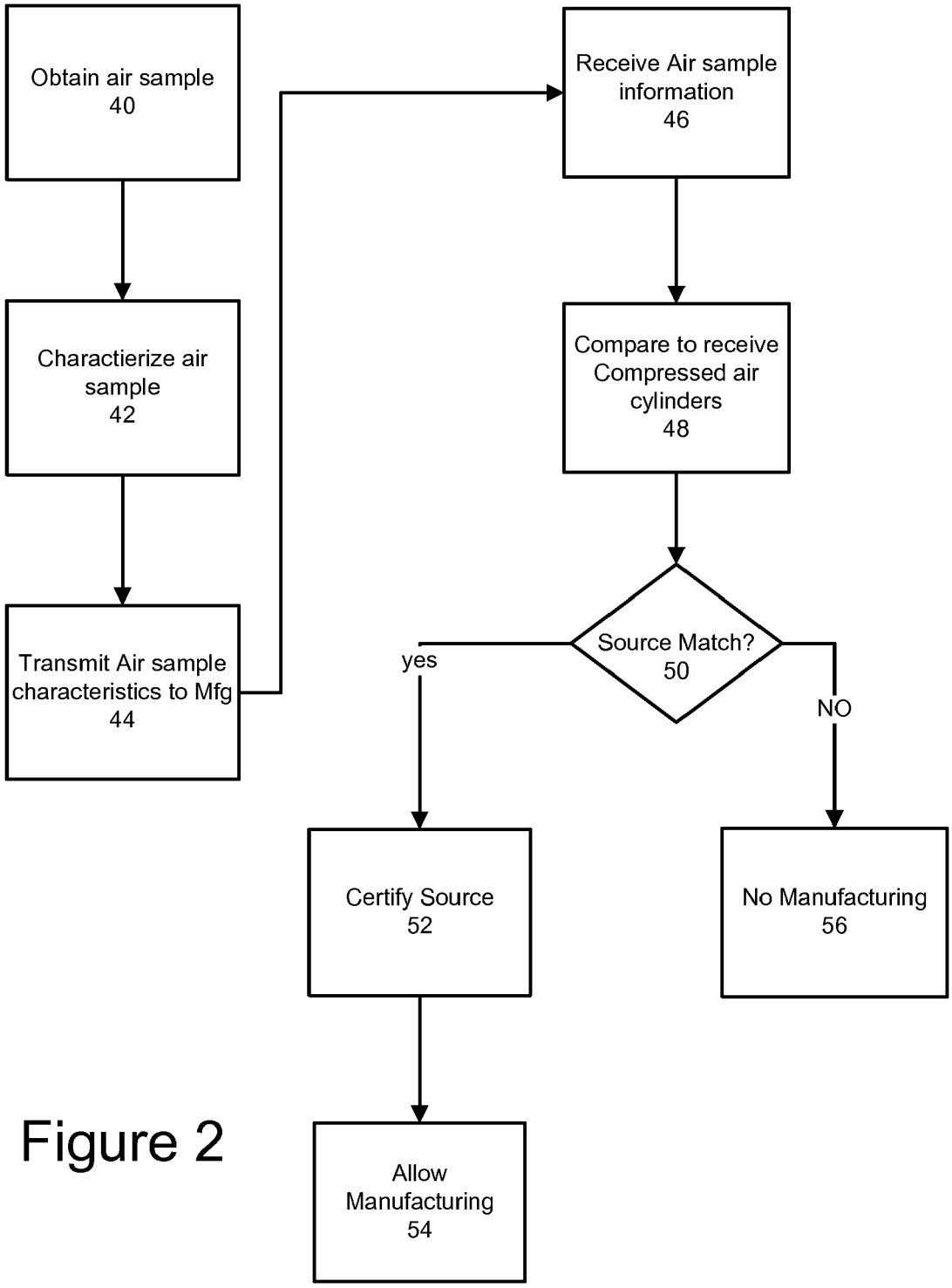
FIG. 2 illustrates a flow for collecting information on air samples that establish the source of the air used in souvenir containers.

Referring now to FIG. 2, collection of air sample information to be used in the manufacturing process is described. As a further quality control measure to assure consumers that the air container being purchased is actually from the region depicted, an air sample is obtained at the same time the compressed air cylinders from the regions are being filled 40. The air sample is analyzed for its chemical compounds in ways known to those skilled in the art to create a compressed air source record. Any air analysis equipment may be used so long as the characteristics of the air can be determined and recorded for subsequent transmission and use. The record of the air sample of the compressed air cylinders from the region is stored, preferably in electronic form for later use.

The stored air characteristics are then sent to the manufacturing facility 44 preferably in advance of the shipment of the compressed air cylinders from the region and received 46 and stored for later use. In this way the manufacturing facility has the air sample data before the arrival of the compressed air cylinders from the region.

When the compressed air cylinders arrive from the region an air sample is taken to create a destination record. This compressed air destination record is compared to the compressed air source record sent electronically from the region. In this way, an accurate comparison of the contents of the compressed air cylinders from the region can be made to the data record of the air that has been sent previously. If the source air data does not match 50 with the air taken from the compressed air cylinders from the region, manufacturing does not take place 56. If the source data does match 50 with air from the compressed air cylinders, the cylinders are certified as coming from the source in question 52 and manufacturing is permitted 54.

Figure 3:
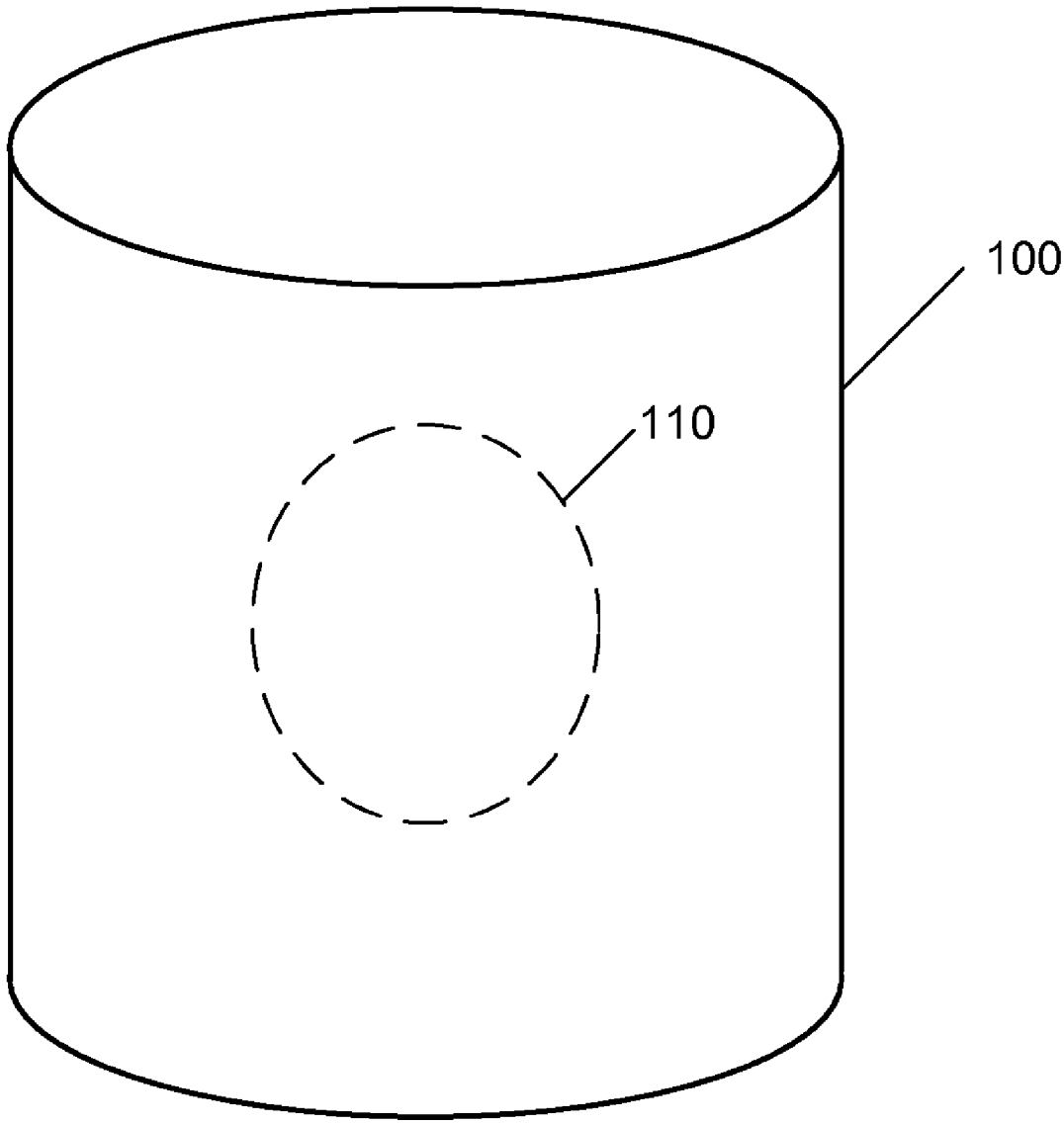
FIG. 3 illustrates one embodiment of a souvenir container.

FIG. 3 illustrates a container 100 with the appropriate labeling 110 identifying the region from which the air was obtained so as to act as a souvenir amusement item. While illustrated as a cylinder or can, any suitable air-tight container can be used and the container can take various shapes and forms without departing from the scope of the invention.

Souvenir amusement items, such as the embodiments described herein, function as keepsakes from a visit, and offer additional amusement for those who possess embodiments described herein. Since the contents are under pressure, at some point any owner can simply open the container and the pressurized air from the locality/region in question will be released. If the air does indeed have a characteristic odor, that will be sensed by the owner as a reminder of the regions from which the contents came.

A souvenir amusement item of manufacture and associated method has now been described. It will be understood by those skilled in the art that the present invention may be, without limitation, embodied in other specific forms without departing from the scope of the invention disclosed and that the examples and embodiments described herein are in all respects illustrative and not restrictive. Those skilled in the art of the present invention will recognize that other embodiments using the concepts described herein are also possible. Further, any reference to claim elements in the singular, for example, using the articles "a," "an," or "the" is not to be construed as limiting the element to the singular. Moreover, a reference to a specific time, time interval, and instantiation of scripts or code segments is in all respects illustrative and not limiting.

I claim:

1. A method for creating an amusement item comprising:

providing a sealable novelty container comprising a label associated with a geographic location;

providing compressed air from the geographic location and storing the compressed in a storage container;

measuring chemical constituents of the compressed air when the compressed air is obtained to create a compressed air source record;

communicating the compressed air source record to a novelty container manufacturing facility;

shipping the compressed air storage container to the novelty container manufacturing facility;

measuring the chemical constituents of the compressed air at the novelty container manufacturing facility to create a compressed air destination record;

comparing the compressed air source record to the compressed air destination record; and if the compressed air source record matches the compressed air destination record, then manufacturing the sealable novelty container comprising the compressed air from the geographic location.

2. The method for creating an amusement item of claim 1 wherein manufacturing the sealable novelty container comprises filling the sealable novelty container with the compressed air from the geographic location and creating a positive pressure within the sealable novelty container.

3. The method for creating an amusement item of claim 1 wherein manufacturing the sealable novelty container comprises filling a plurality of sealable novelty containers with the compressed air from the compressed air storage container; and ceasing the filling of the plurality of sealable novelty containers when the pressure in the compressed air storage container falls below a selectable level.

4. The method for creating an amusement item of claim 1 wherein communicating the compressed air source record comprises sending an electronic compressed air source record over a network.

5. The method for creating an amusement item of claim 1 wherein the sealable novelty container is taken from the group consisting of aluminum cans, polymer canisters, and glass containers.

* * * * *